US005270483A

United States Patent [19]

Inoue et al.

[11] Patent Number: 5,270,483

[45] Date of Patent: Dec. 14, 1993

[54] DEVELOPING APPARATUS

[75] Inventors: Yoshio Inoue; Yoshikazu Okamoto; Yoshikazu Takahashi; Takashi Fuchiwaki; Tomoyoshi Chihara, all of Kanagawa, Japan

[73] Assignee: Fuji Xerox Co., Ltd., Tokyo, Japan

[21] Appl. No.: 34,415

[22] Filed: Mar. 19, 1993

[30] Foreign Application Priority Data

Mar. 31, 1992 [JP] Japan ..... 4-077141

[51] Int. Cl.[5] ..... G03G 15/06

[52] U.S. Cl. ..... 118/647; 355/261

[58] Field of Search ..... 355/261, 263, 265, 296, 355/245; 118/647, 649, 652

[56] References Cited

U.S. PATENT DOCUMENTS

| | | | |
|---|---|---|---|
| 4,868,600 | 9/1989 | Hays et al. | 355/259 |
| 5,031,570 | 7/1991 | Hays | 118/654 |
| 5,032,872 | 7/1991 | Folkins et al. | 355/259 |
| 5,053,824 | 10/1991 | Schram | 355/259 |
| 5,063,875 | 12/1991 | Folkins et al. | 118/651 |
| 5,134,442 | 7/1992 | Folkins et al. | 355/264 |
| 5,144,371 | 9/1992 | Hays | 355/249 |
| 5,153,642 | 10/1992 | Folkins et al. | 355/215 |
| 5,153,647 | 10/1992 | Barker et al. | 355/245 |
| 5,204,719 | 4/1993 | Bares | 355/247 |
| 5,206,693 | 4/1993 | Folkins | 355/261 |

FOREIGN PATENT DOCUMENTS

| | | |
|---|---|---|
| 0414455A2 | 2/1991 | European Pat. Off. . |
| 1-193771 | 8/1989 | Japan . |
| 1-243083 | 9/1989 | Japan . |
| 1-304477 | 12/1989 | Japan . |

*Primary Examiner*—R. L. Moses

*Attorney, Agent, or Firm*—Finnegan, Henderson, Farabow, Garrett & Dunner

[57] ABSTRACT

A developing apparatus for developing a latent image on a surface of a photosensitive body by forming a toner cloud in a developing region through electrode wire, in which movably supporting units for supporting electrode supporting unit movably between operative positions and inoperative positions are provided so that the electrode wire supported by the electrode supporting units can be kept in an operative position near to a surface of a developing roll when the electrode supporting units are in their operative positions and, on the other hand, the electrode wire can be kept in an inoperative position far from the surface of the developing roll when the electrode supporting units are in their inoperative positions. Thereby, foreign matters trapped in the electrode wire or accumulated on the electrode wire can be removed easily.

14 Claims, 8 Drawing Sheets

DEVELOPING APPARATUS

BACKGROUND OF THE INVENTION

1. Field of Invention

The present invention relates to a developing apparatus used in image forming apparatus such as copying machines, printers, or the like, using electronic photography and, more particularly, relates to a developing apparatus in which a latent image on a photosensitive body is developed in the process in which toner is formed on a developing roll, and a toner cloud is formed in a developing region through an electrode wire which is arranged so as to be near to a layer of the toner formed on the developing roll or so as to be in contact with the layer of the toner.

2. Description of Prior Art

Heretofore, Unexamined Japanese Patent Publication Hei-1-304477 has described a developing apparatus as described above.

Further, Japanese Patent Unexamined Publication No. Hei-3-113474 has described a developing apparatus in which a latent image on a surface of a photosensitive body is developed through the process in which a toner layer is formed by feeding a two-component developer to a developing roll by using a toner supply roll and by transferring toner onto the developing roll, and a toner cloud is formed through an electrode wire which is arranged so as to be near to the toner layer or so as to be in contact with the toner layer.

According to these types of developing apparatuses, for the achievement of highly efficient developing, a toner cloud is formed in the neighborhood of the electrode wire by means of applying an AC voltage to the electrode wire which is arranged so as to be near to the toner layer formed on the developing roll or so as to be in contact with the toner layer, or by any other like means.

In the following, the above-mentioned developing apparatus, that is, a developing apparatus in which a latent image on a surface of a photosensitive body is developed by forming a toner cloud through electrode wire, will be described with reference to FIGS. 13 and 14.

In FIG. 14, the developing apparatus 100 has a developing vessel 101 for storing a predetermined amount of a developer. A developing roll 102 and a toner supply roll 103 are mounted so as to be rotatable in the inside of the developing vessel 101. The developing roll 102 can be rotated in both of same and opposed directions with respect to the direction of movement of a photosensitive body D. Similarly, the toner supply roll 103 can be also rotated in both of same and opposite directions with respect to the direction of rotation of the developing roll 102, in relation to the arrangement of a limiting member which will be described later. In FIG. 14, the developing roll 102 is rotated in the direction reverse to the direction of movement of the photosensitive body D, whereas the toner supply roll 103 is rotated in a same direction with the developing roll 102 so that they are moved relatively reversely at a proximate portion.

An auger 104 for mixing and stirring the developer is mounted in the inside of the developing vessel 101 so as to be rotatable.

An electrode wire W is disposed between the developing roll 102 and the photosensitive body D. The electrode wire W is automatically departed from the developing roll 102 by a toner layer formed on the developing roll 102, so that the distance between the electrode wire W and the developing roll 102 becomes equal to the thickness of the toner layer. The distance between the electrode wire W and the developing roll 102 is generally from about 5 μm to about 30 μm. Opposite end portions of the electrode wire W are mounted slightly inward with respect to a cylindrical surface containing a surface of the developing roll 102 containing the toner layer.

In FIG. 14, a two-component developer constituted by carrier and toner is put up to the height h shown in the drawing. The developer is attracted to a surface of the toner supply roll 103 by magnetic force of a magnet 103*a* fixed in the inside of the toner supply roll 103 and is conveyed toward the developing roll 102 by rotation of the toner supply roll 103. The developer on the toner supply roll 103 is measured by a limiting member 105 so intermediately that a predetermined amount of the developer can be continuously conveyed to a region between the toner supply roll 103 and the developing roll 102.

A DC bias voltage source 106 and a DC bias voltage source 107 are connected to the toner supply roll 103 and the developing roll 102, respectively. A voltage of about −400 volts and a voltage of about −300 volts are applied to the toner supply roll 103 and the developing roll 102 by these electric sources 106 and 107, respectively, so that an electrostatic field is formed between the developing roll 102 and the toner supply roll 103 to thereby attract toner particles from the toner supply roll 103 to the developing roll 102. Thus, a toner layer of even thickness is formed on the surface of the developing roll 102.

An AC bias voltage is applied to the electrode wire W by an AC source 108. An AC field is formed between the electrode wire W and the developing roll 102 by the applied AC bias voltage, so that toner is separated from the surface of the developing roll 102. Thus, a toner cloud is formed around the electrode wire W. The AC bias voltage is from about 200 bolts to about 1000 bolts as peak voltage at a frequency of about 3 kHz to about 15 kHz.

The voltage of about −300 bolts from the AC bias source 107 is applied to the developing roll 102, so that an electrostatic field is formed between the developing roll 102 and the photosensitive body D. As a result, the toner particles separated from the toner cloud formed around the electrode wire W are attracted to a latent image recorded on the photosensitive body D. In such apparatus, the electrode wire W or the developing roll 102 may be coated with a dielectric material to assist in preventing the applied AC voltage from being short-circuited.

The toner supply roll 103 supplies new toner again to a portion where toner is removed from the developing roll 102 by development. At this time, a predetermined amount of toner substantially having a constant electric charge can be accumulated on the developing roll 102 by combining while adjusting the distance between the developing roll 102 and the toner supply roll 103, the amount of the two-component developer on the toner supply roll 103, the magnetic characteristic of the toner supply roll 103, the rotating speed ratio of the toner supply roll 103 to the developing roll 102, the voltages of the DC bias sources 106 and 107 and the electrical conductivity of the carrier contained in the two-component developer.

According to the developing apparatus 100 described above with reference to FIG. 14, for the achievement of highly efficient developing, a toner cloud is formed in the neighborhood of the electrode wire W by means of applying an AC voltage to the electrode wire W which is arranged so as to be near to a toner layer formed on the developing roll 02 or so as to be in contact with the toner layer.

In the following, the configuration of the periphery of the electrode wire W will be described with reference to FIG. 13. FIG. 13 is a horizontal sectional view of the above-mentioned developing apparatus 100.

An electrode supporting member 110 is fixed to one side wall 101*a* of the developing vessel 101. The electrode supporting member 110 is constituted by a bracket 111 fixed to the side wall 101*a*, and a wire fixing member 112 and a wire positioning member 113 which are supported by the bracket 111.

An electrode supporting member 115 is also fixed to another side wall 101*b* of the developing vessel 101. The electrode supporting member 115 is constituted by a bracket 116 fixed to the side wall 101*b*, and a wire fixing member 117 and a wire positioning member 118 which are supported by the bracket 116.

The above-mentioned electrode wire W is suspended between the electrode supporting members 110 and 115. The electrode wire W is guided by the wire positioning members 113 and 118 while being kept in a tensioned state by a tension spring S provided for application of a tensile force. Outer end portions of the electrode wire W are fixed by the wire fixing members 112 and 117. The electrode wire W is in contact with the wire positioning members 113 and 118.

If a foreign matter, such as a bulky toner particles, the aggregate of toner, dust fiber floating in air, paper fiber forming transfer paper, or the like, is trapped in the above-mentioned electrode wire W in a period of developing, it may be locally accumulated on the electrode wire W portion. Because this causes the production of stripes in the toner layer formed on the developing roll 102 or the local disorder in evenness of electric field formed by the bias voltage applied to the electrode wire W, there arises a problem in that various image defects may be brought.

At the time of maintenance, therefore, it is necessary to remove the so-called foreign matter accumulated on the electrode wire W.

The above-mentioned wire W is however selected so that its diameter is generally in a relatively narrow range of about 50 μm to about 100 μm (this range being limited to a lower limit by physical strength and to an upper limit by the distance between the photosensitive body and a donor member). As a result, the strength of the electrode wire W becomes so small that removal of the above-mentioned foreign matter without breaking of the wire is required at the time of maintenance.

The removal of the foreign matter in the condition that the electrode wire W and the developing roll 102 are proximate to each other, however, requires careful work. As a result, increase of working time, increase of working labor, and so on, are incurred. In the case where the electrode wire W is broken by mistake, wire exchanging work is required so that the number of working steps at the time of maintenance increases. As a result, the burden on the user becomes heavy.

SUMMARY OF THE INVENTION

Upon such circumstances, the present invention has as its object the provision of a developing apparatus for developing a latent image on a surface of a photosensitive body by forming a toner cloud in a developing region through electrode wire arranged so as to be near to a toner layer formed on a developing roll or so as to be in contact with the toner layer, in which foreign matter trapped in the electrode wire or accumulated on the electrode wire can be removed easily.

In the following, the configuration of the present invention to solve the above-mentioned problems will be described. Numerals respectively put in parentheses are given to constituent elements of the present invention to facilitate the correspondence with constituent elements of embodiments which will be described later. The reason why the present invention will be described below in correspondence with numerals given in embodiments which will be described later, is for facilitating the understanding of the present invention, not for limiting the scope of the present invention to the embodiments.

To solve the problems, according to a first aspect of the present invention, the developing apparatus comprises: a developing vessel (1) for accommodating a developing roll (2) having its surface on which a layer of toner to be deposited on a surface of a photosensitive body (D) is formed, and further accommodating a toner supply member (3, 4) for supplying the toner to the developing roll (2); electrode supporting members (S1, S2, S3, S4) respectively arranged at opposite end portions of the developing roll (2) in the direction of axis (2*a*) thereof; electrode wires (W1, W2) respectively supported by the electrode supporting members (S1, S2, S3, S4) so as to be disposed between the surface of the photosensitive body (D) and the developing roll (2); field application means for applying an AC field between the electrode wires (W1, W2) and the developing roll (2), whereby a toner cloud is formed between the surface of the photosensitive body (D) and the developing roll (2) by applying an AC field to the electrode wires (W1, W2); and movably supporting members (P1, P2, P3, P4) for movably supporting the electrode supporting members (S1, S2, S3, S4) between their operative positions and their inoperative positions so that the electrode wires (W1, W2) supported by the respective electrode supporting members (S1, S2, S3, S4) are kept in their operative positions near to the surface of the developing roll (2) when the electrode supporting members (S1, S2, S3, S4) are in their operative positions respectively, while the electrode wires (w1, w2) supported by the electrode supporting members (S1, S2, S3, S4) are kept in their inoperative positions far from the surface of the developing roll (2) when the electrode supporting members (S1, S2, S3, S4) are in their inoperative positions respectively.

The developing apparatus according to a second aspect of the present invention is characterized in that the electrode supporting members (S1, S2) are connected by connection members (T) for fixing relative positions of the electrode supporting members (S1, S2).

The developing apparatus according to a third aspect of the present invention is characterized in that the electrode supporting members (S1, S2) have brackets (10, 14, 30) supported to side walls of the developing vessel (1) at the opposite end portions of the developing roll (2) with respect to the direction of the shaft (2*a*) the developing roll (2), and wire fixing members (12, 16, 32*a*, 32*b*) and wire positioning members (13, 17, 33) supported by the brackets (10, 14, 30).

The developing apparatus according to a fourth aspect of the present invention is characterized in that the movably supporting members (P1, P2, P3, P4) have radially movably supporting means (10*d*, 14*d*, 30*d*) for supporting the electrode supporting members (S1, S2, S3, S4) to be movable in the direction of radius of the developing roll (2).

The developing apparatus according to a fifth aspect of the present invention is characterized in that the movably supporting members (P1, P2, P3, P4) have circumferentially movably supporting means (10*b*, 14*b*, 30*e*) for supporting the electrode supporting members (S1, S2, S3, S4) to be turnable around an axial line parallel to the axial line of the developing roll (2) in the condition where the electrode supporting members (S1, S2, S3, S4) are moved in the direction of radius of the developing roll (2) by the radially movably supporting means (10*d*, 14*d*, 30*d*) so that the electrode wires (W1, W2) are far from the surface of the developing roll (2).

The developing apparatus according to a sixth aspect of the present invention is characterized in that each of the brackets (30) in the electrode supporting members (S3, S4) is provided with a normal wire fixing member (32*a*) for fixing an electrode wire (W1) used normally, and with an another, spare wire fixing member (32*b*); and the wire fixing members (32*a*, 32*b*) are arranged so that when an electrode wire (W1) supported by one wire fixing member (32*a*) is kept in an operative position by the circumferentially movably supporting means (30*e*), an electrode wire (W2) supported by the other wire fixing member (32*b*) is kept in an inoperative position.

The developing apparatus according to a seventh aspect of the present invention is characterized in that the circumferentially movably supporting means (10*d*, 14*d*) are constituted by long mount holes (10*a*, 14*a*) which are formed in the brackets (10, 14) so that the shaft (2*a*) of the developing roll (2) passes through the long mount holes (10*a*, 14*a*); and each of the long mount holes (10*a*, 14*a*) has a shape by which the shaft (2*a*) of the developing roll (2) passing through the mount holes (10*a*, 14*a*) is permitted to move relative to a direction of the length of the mount holes (10*a*, 14*a*).

The developing apparatus according to an eighth aspect of the present invention is characterized in that each of the brackets (10, 14) is formed of a thermoplastic molding; each of the long mount holes (10*a*, 14*a*) of the brackets (10, 14) through which the shaft (2*a*) of the developing roll (2) passes is composed of round hole portions (10*b*, 10*c*, 14*b*, 14*c*) at its opposite ends, and a round hole connection portion (10*d*, 14*d*) for connecting the round hole portions (10*b*, 10*c*, 14*b*, 14*c*); each of the round hole portions (10*b*, 10*c*, 14*b*, 14*c*) has such a shape as to be easily rotatable around the shaft (2*a*) of the developing roll (2); and the round hole connection portion (10*d*, 14*d*) is formed so that it has a width slightly smaller than the diameter of the shaft (2*a*) of the developing roll (2).

The developing apparatus according to a ninth aspect of the present invention is characterized in that, in the developing apparatus according to the fifth or sixth aspect of the present invention, the movably supporting means (P3, P4) are constituted by L-shaped mount holes (30*a*) which are formed in the brackets (30) so that the shaft (2*a*) of the developing roll (2) passes through the L-shaped mount holes (30*a*); each of the L-shaped mount holes (30*a*) has such a shape that the shaft (2*a*) of the developing roll (2) passing through the L-shaped mount hole (30*a*) is relatively movable along the L-shaped mount hole (30*a*), and also has such a shape so as to be easily rotatable around the shaft (2*a*).

The developing apparatus according to a tenth aspect of the present invention is characterized in that each of the brackets (30) is formed of a thermoplastic molding; each of the L-shaped mount holes (30*a*) of the brackets (30) through which the shaft (2*a*) of the developing roll (2) passes is composed of round hole portions (30*b*, 30*c*) at its opposite ends, and a round hole connection portion (30*d*) for connecting the round hole portions; the round hole connection portion (30*d*) is formed so that it has a width slightly smaller than the diameter of the shaft (2*a*) of the developing roll (2); and each of the round hole connection portion (30*d*) has a bent portion (30*e*) formed at its intermediate portion and shaped so as to be easily rotatable around the shaft (2*a*) of the developing roll (2).

In the developing apparatus according to the first aspect of the present invention, toner from the toner supply members (3, 4) is supplied to the developing roll (2) accommodated in the developing vessel (1), so that a layer of toner to be deposited on a surface of the photosensitive body (D) is formed on a surface of the developing roll (2). The electrode wires (W1, W2) supported by the electrode supporting members (S1, S2) respectively arranged at opposite end portions of the developing roll (2) with respect to the direction of the shaft (2*a*) of the developing roll (2) are disposed between the surface of the photosensitive body (D) and the developing roll (2). An AC field is applied between the electrode wires (W1, W2) and the developing roll (2) by the field application means. A toner cloud is formed between the surface of the photosensitive body (D) and the developing roll (2) by application of the AC field.

The electrode supporting members (S1, S2, S3, S4) can be moved between operative positions and inoperative positions by the movably supporting means (P1, P2, P3, P4), respectively. When the electrode supporting members (S1, S2, S3, S4) are in the operative positions, the electrode wires (W1, W2) supported by the electrode supporting members (S1, S2, S3, S4) are kept in operative positions near to the surface of the developing roll (2). When, on the contrary, the electrode supporting members (S1, S2, S3, S4) are in the inoperative positions, the electrode wires (W1, W2) are kept in inoperative positions far from the surface of the developing roll (2).

Accordingly, when the electrode wires (W1, W2) are moved from the operative positions to the inoperative positions by the movably supporting means (P1, P2, P3, P4), the electrode wires (W1, W2) are departed from the surface of the developing roll (2). As a result, space required for cleaning the electrode wires (W1, W2) can be secured between the electrode wires (W1, W2) and the developing roll (2).

In the developing apparatus according to the second aspect of the present invention, the electrode supporting members (S1, S2) are connected by a connection member (T) for fixing relative positions of the electrode supporting members (S1, S2). Accordingly, the electrode supporting members (S1, S2) provided at opposite end portions of the developing roll (2) with respect to the direction of the shaft (2*a*) of the developing roll (2)

can be moved with predetermined postures while being linked with the connection member (T). As a result, because the electrode wire (W1) is moved while being kept in a predetermined posture supported by the electrode supporting members (S1, S2), there is no production of torsional stress in the electrode wire (W1).

In the developing apparatus according to the third aspect of the present invention, the electrode supporting members (S1, S2) have brackets (10, 14, 30) supported to side walls of the developing vessel (1) at opposite end portions of the developing roll (2) with respect to the direction of the shaft (2*a*) of the developing roll (2). Wire fixing members (12, 16, 32*a*, 32*b*) and wire positioning members (13, 17, 33) are supported by the brackets (10, 14, 30). Accordingly, the electrode wires (W1, W2) can be easily moved from operative positions to inoperative positions by moving the brackets (10, 14, 30).

In the developing apparatus according to the fourth aspect of the present invention, the movably supporting means (P1, P2, P3, P4) have radially movably supporting means (10*d*, 14*d*, 30*d*). Because the radially movably supporting means (10*d*, 14*d*, 30*d*) can move the electrode supporting members (S1, S2, S3, S4) in the direction of radius of the developing roll (2), the electrode wires (W1, W2) supported by the electrode supporting members (S1, S2, S3, S4) can be moved away from the surface of the developing roll (2) by the same distance as the moved distance of the electrode supporting members (S1, S2, S3, S4). That is, the moved distance of the electrode wires (W1, W2) in the direction of departing from the surface of the developing roll (2) can be maximized per unit moved distance of the electrode supporting members (S1, S2, S3, S4).

The developing apparatus according to the fifth aspect of the present invention comprises radially movably supporting means (30*e*). The radially movably supporting means (30*e*) can turn the electrode supporting members (S3, S4) around an axial line parallel to the axial line of the developing roll (2) in the condition that the electrode wires (W1, W2) are moved away from the surface of the developing roll (2) by moving the electrode supporting members (S3, S4) in the direction of radius of the developing roll (2) through the radially movably supporting means (30*d*).

Accordingly, in the developing apparatus according to the fifth aspect of the present invention, the electrode wires (W1, W2) can be moved to positions having no influence on the surface of the developing roll (2) at the time of maintenance of the electrode wires (W1, W2), that is, the electrode wires (W1, W2) can be moved to positions facilitating maintenance work.

In the developing apparatus according to the sixth aspect of the present invention, a normal wire fixing member (32*a*) and another, spare wire fixing member (32*b*) are provided to the bracket (30) of the electrode supporting members (S3, S4) which can be turned around an axial line parallel to the axial line of the developing roll (2) by the circumferentially movably supporting means (30*e*). An electrode wire (W1) used normally is fixed to the normal wire fixing member (32*a*). A spare wire (W2) is fixed to the spare wire fixing member (32*b*). The wire fixing members (32*a*, 32*b*) are provided so that when the electrode wire (W1) supported by one wire fixing member (32*a*) is kept in an operative position by the circumferentially movably supporting means (30*e*), the electrode wire (W2) supported by the other wire fixing member (32*b*) is kept in an inoperative position.

Accordingly, in the case where one electrode wire (W1) in an operative position is cut off, the other electrode wire (W2) can be used after it is moved from an inoperative position to an operative position.

In the developing apparatus according to the seventh aspect of the present invention, the radially movably supporting means (10*d*, 14*d*) are constituted by long mount holes (10*a*, 14*a*) which are formed in the brackets (10, 14) and through which the shaft (2*a*) of the developing roll (2) passes. Each of the long mount holes (10*a*, 14*a*) has such a shape that the shaft (2*a*) of the developing roll (2) passing through the mount holes (10*a*, 14*a*) can be relatively moved in the direction of the length of the long mount holes (10*a*, 14*a*). Accordingly, the brackets (10, 14) can be moved in the condition that the direction of the length of the long mount holes (10*a*, 14*a*) coincides with the direction of radius of the developing roll (2). In this case, the moved distance (that is, approaching distance and departing distance) of the electrode wire (W1) with respect to the surface of the developing roll (2) can be maximized per unit moved distance of the electrode supporting members (S1, S2).

In the developing apparatus according to the eighth aspect of the present invention, each of the brackets (10, 14) is a thermoplastic molding. Further, each of the long mount holes (10*a*, 14*a*) of the brackets (10, 14) through which the shaft (2*a*) of the developing roll (2) passes is composed of round hole portions (10*b*, 10*c*, 14*b*, 14*c*) at its opposite ends, and a round hole connection portion (10*d*, 14*d*). Each of the round hole connection portions (10*d*, 14*d*) is formed so that its width is slightly smaller than the diameter of the shaft (2*a*) of the developing roll (2).

As described above, each of the round hole connection portions (10*d*, 14*d*) of the brackets (10, 14) is formed so that its width is slightly smaller than the diameter of the shaft (2*a*) of the developing roll (2). However, the width of each of the round hole connection portions can be increased temporarily, because each of the brackets (10, 14) is a thermoplastic molding and can be elastically deformed. Accordingly, the brackets (10, 14) can be moved from a state where the shaft (2*a*) passes through the round hole portions (10*c*, 14*c*) at one end of the long mount holes (10*a*, 14*a*) to a state where the shaft (2*a*) passes through the round hole portions (10*b*, 14*c*) at the other end.

In the case where the brackets (10, 14) are moved to a state where the shaft (2*a*) passes through the round hole portions (10*b*, 14*c*) via the round hole connection portions (10*d*, 14*d*), the operator moving the brackets (10, 14) can obtain a feeling of clicking when a state where the shaft (2*a*) passes through the round hole portions (10*b*, 14*c*) is reached. Accordingly, the work of radially moving the electrode wire (W) can be performed securely and easily.

Because such of the round hole portions (10*b*, 10*c*, 14*b*, 14*c*) has such a shape that it can be easily rotated around the shaft (2*a*) of the developing roll (2), the electrode supporting members (S3, S4) can be turned around an axial line parallel to the axial line of the developing roll (2) in the condition that the brackets (10, 14) are moved so radially that the electrode wire (W1) is moved away from the surface of the developing roll (2). That is, means for turning the electrode wire supporting members (S1, S2, S3, S4) around an axial line parallel to the axial line of the developing roll (2) can be provided by simple configuration. In other words, circumferentially movably supporting means (10*b*, 14*b*) can be provided by simple configuration.

Accordingly, in the developing apparatus according to the eighth aspect of the present invention, by such simple configuration, the electrode wires (W1, W2) can be easily moved to positions having no influence on the surface of the developing roll (2) at the time of maintenance of the electrode wires (W1, W2), that is, the electrode wires (W1, W2) can be moved to positions facilitating maintenance work.

In the developing apparatus according to the ninth aspect of the present invention, each of the movably supporting means (P3, P4) is constituted by an L-shaped mount hole (30*a*) which is formed in the bracket (30) and through which the shaft (2*a*) of the developing roll (2) passes. The L-shaped mount hole (30*a*) has such a shape that the shaft (2*a*) of the developing roll (2) passing through the mount hole (30*a*) can be relatively moved along the L-shaped mount hole (30*a*). Accordingly, the mount positions of the brackets (10, 14) with respect to the developing vessel (1) can be moved in directions along two linear portions of the mount hole (30*a*). Furthermore, the linear portions of the mount hole (30*a*) can be set so as to coincide with the direction of radius of the developing roll (2). That is, the L-shaped mount hole 30*a* can move the electrode wire supporting members (S3, S4) to the direction of radius of the developing roll (2).

Because the mount hole (30*a*) has such a shape as to be easily rotatable around the shaft (2*a*), the mount posture of the bracket (30) with respect to the developing vessel (1) can be changed so as to be rotatable around the shaft (2*a*) of the developing roll (2).

That is, in the developing apparatus according to the ninth aspect of the present invention, radially movably supporting means and circumferentially movably supporting means can be provided by the L-shaped mount hole (30*a*) which is simple in configuration.

In the developing apparatus according to the tenth aspect of the present invention, the bracket (30) is a thermoplastic molding. Further, the L-shaped mount hole (30*a*) of the bracket (30) through which the shaft (2*a*) of the developing roll (2) passes, is composed of round hole portions (30*b*, 30*c*) at its opposite ends, and a round hole connection portion (30*d*) for connecting the round hole portions. The round hole connection portion (30*d*) is formed so that its width is slightly smaller than the diameter of the shaft (2*a*) of the developing roll (2).

As described above, the round hole connection portion (30*d*) of the bracket (30) is formed so that its width is slightly smaller than the diameter of the shaft (2*a*) of the developing roll (2). However, the width of the round hole connection portion can be increased temporarily, because the bracket (30) is a thermoplastic molding and can be elastically deformed. Accordingly, the bracket (30) can be moved from a state where the shaft (2*a*) passes through the round hole portion (30*c*) at one end of the long mount hole (30*a*) to a state where the shaft (2*a*) passes through the round hole portion (30*b*) at the other end.

In the case where the bracket (30) is moved to a state where the shaft (2*a*) passes through the round hole portion (30*b*) via the round hole connection portion (30*d*), the operator moving the bracket (30) can obtain a feeling of clicking when a state where the shaft (2*a*) passes through the round hole portion (30*b*) is reached. Accordingly, the work of moving the electrode wires (W1, W2) can be performed securely and easily.

A bent portion (30*e*) at an intermediate portion of the round hole connection portion (30*d*) has such a shape that the bracket (30) can be easily rotated around the shaft (2*a*) of the developing roll (2). Although the bent portion (30*e*) having such a shape is simple in configuration, the function of circumferentially movably supporting means can be provided.

When circumferentially movably supporting means (30*e*) is constituted by the bent portion (30*e*) at the intermediate portion of the L-shaped mount hole (30*a*) as described above, the bracket (30) can be turned in the condition that the shaft (2*a*) of the developing roll (2) passes through the bent portion (30*e*), and then can be moved in the directions of the two linear portions of the L-shaped mount hole (30).

If, in this case, a normal wire fixing member (32*a*) and a spare wire fixing member (32*b*) are provided to the bracket (30) so as to be disposed on extension lines of the two linear portions of the mount hole (30), exchange between the electrode wire (W1) fixed to the normal wire fixing member (32*a*) and the spare electrode wire (W2) fixed to the spare wire fixing member (32*b*) can be made in a shorter time more easily.

BRIEF DESCRIPTION OF THE DRAWINGS

FIG. 3A is a general view of the right side, seen from the arrow IIA. FIG. 3B is a detailed explanatory view of important part (indicated by the arrow IIB) in FIG. 3A.

DETAILED DESCRIPTION OF PREFERRED EMBODIMENTS

Embodiments of the developing apparatus according to the present invention will be described with reference to the drawings.

First embodiment of the developing apparatus according to the invention will be described with reference to FIGS. 1 through 6.

Figure 1:
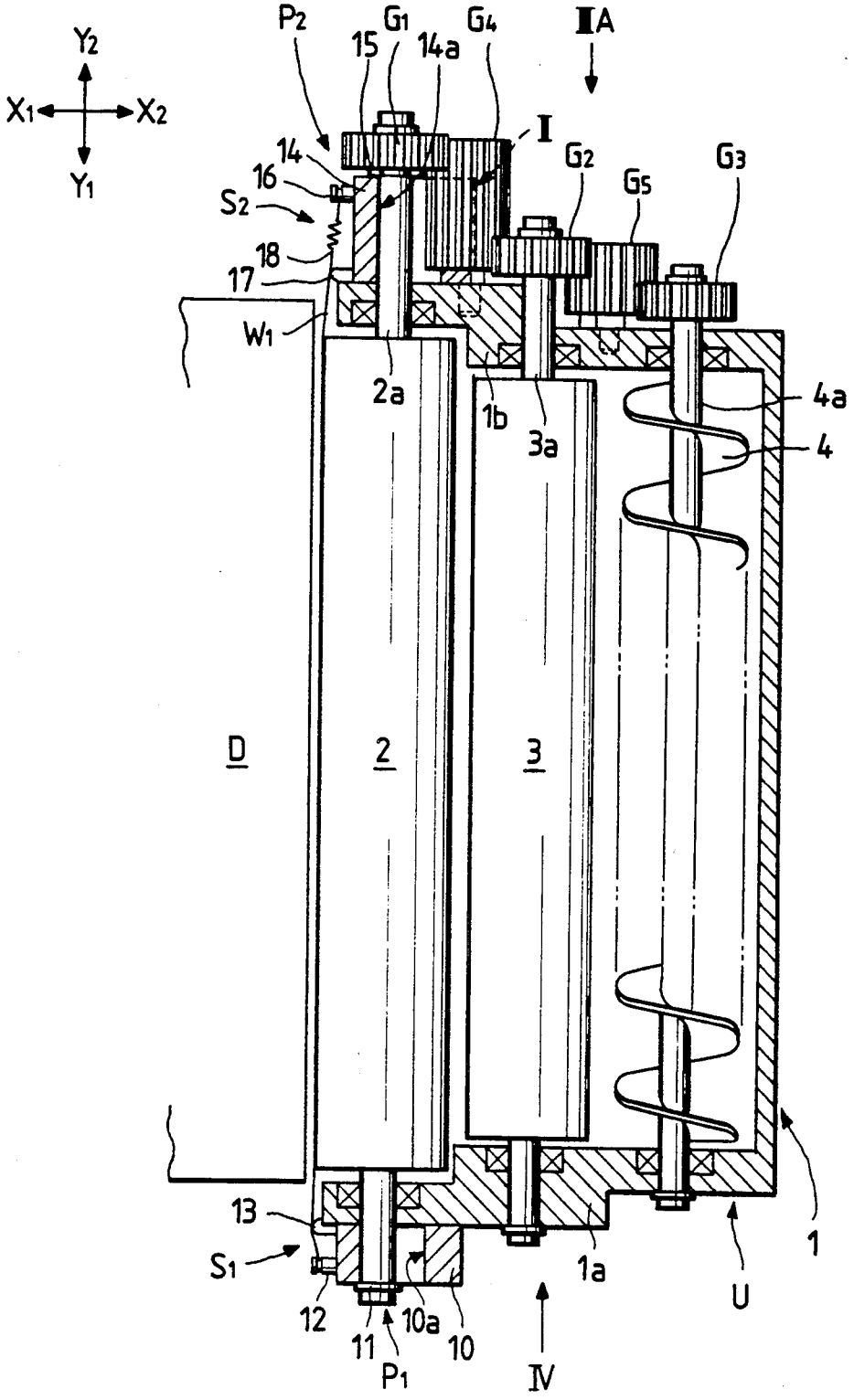
FIG. 1 is a horizontal sectional view of Embodiment 1 of a developing apparatus disposed around a photosensitive body.
Figure 2:
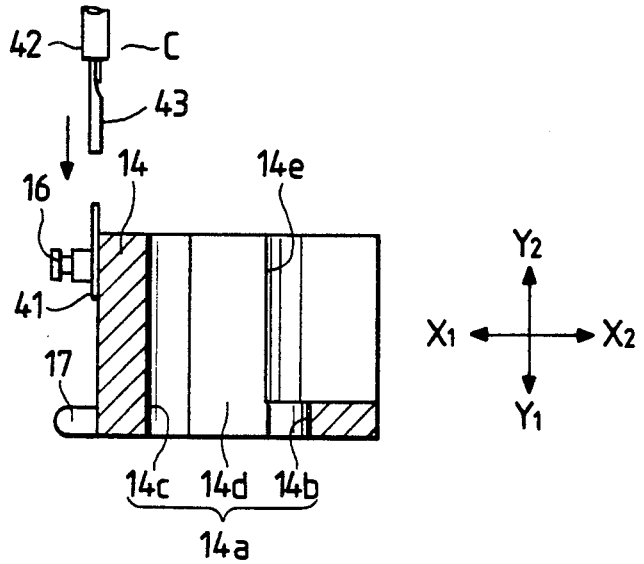
FIG. 2 is a detailed view of important part (indicated by the arrow IB) in FIG. 1.
Figure 3A:
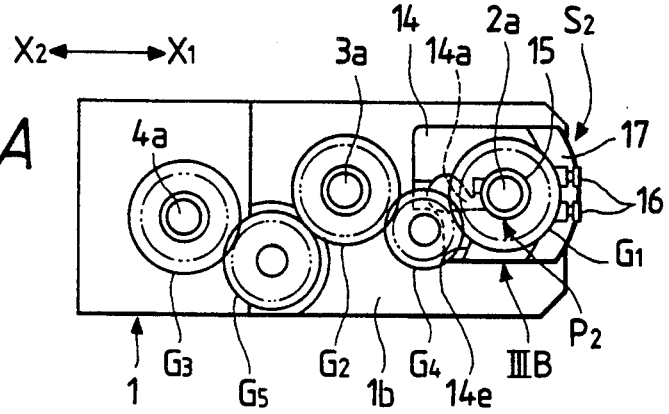
FIGS. 3A and 3B are explanatory views of the right side (Y2-side in FIG. 1) of the Embodiment 1.
Figure 3B:
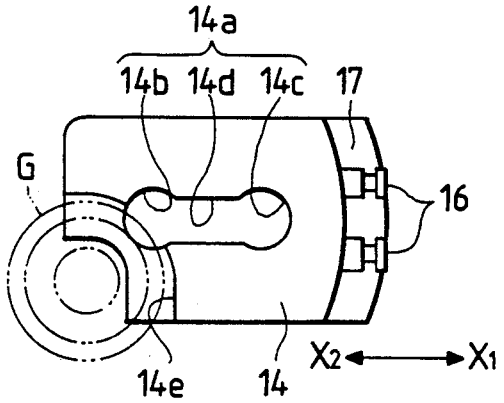
Figure 4:
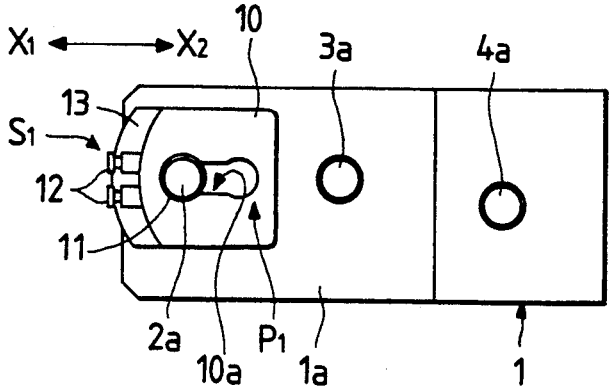
FIG. 4 is a view seen from the arrow III in FIG. 1.
Figure 5:
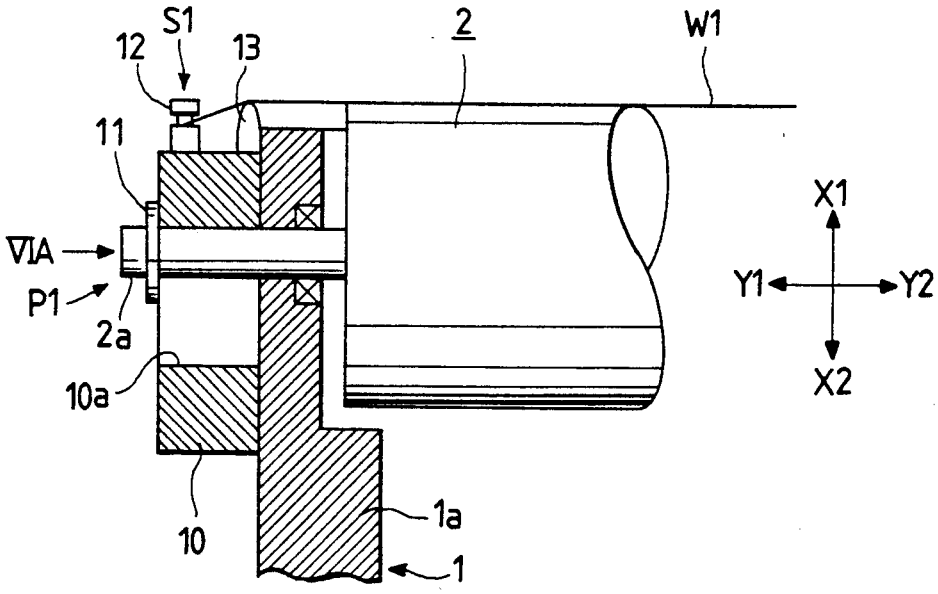
FIG. 5 is an enlarged view of important part in FIG. 1.
Figure 6A:
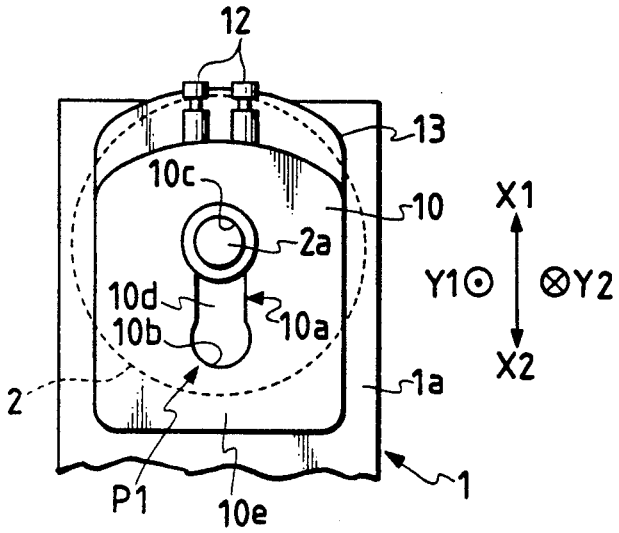
FIGS. 6A through 6C are views for explaining the operation of the Embodiment 1 of the developing apparatus.
Figure 6B:
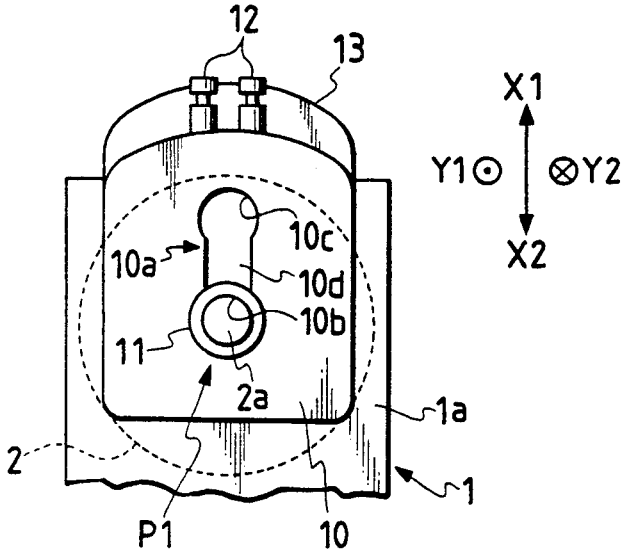
Figure 6C:
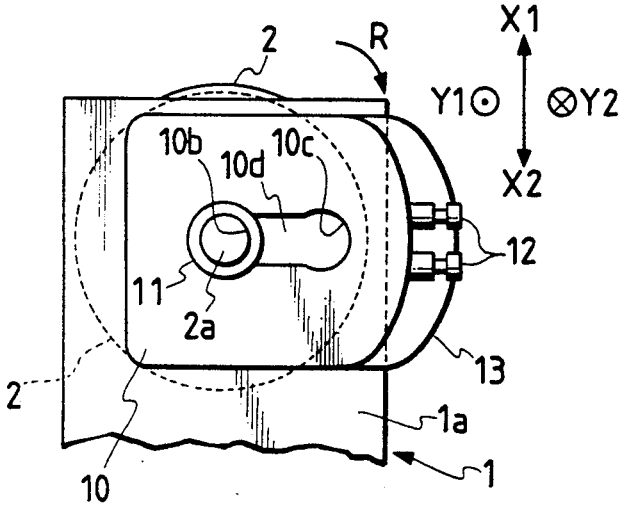

FIG. 1 is a horizontal sectional view of the developing apparatus disposed around a photosensitive body. FIG. 2 is a detailed view of important part (shown by the arrow II) in FIG. 1. FIG. 3 is an explanatory view of the right side (Y2 side in FIG. 1) of Embodiment 1. FIG. 3A is a general view of the right side. FIG. 3B is a detailed explanatory view of important part (shown by the arrow IIIB) of FIG. 3A. FIG. 4 is a view seen from the arrow IV in FIG. 1. FIG. 5 is an enlarged plan view of important part of FIG. 1. FIGS. 6A to 6C are views for explaining the operation of this embodiment. FIG. 6A is a view seen from the arrow VIA in FIG. 5.

In description of embodiments of the invention, the term "forward" means the direction indicated by X1 in the drawing (that is, the right direction in FIG. 3, the left direction in FIG. 4). The term "left" means the left-hand direction (that is, the Y1 direction in FIG. 1) in the case where the "forward", that is, the X1 direction is directed. In the drawings, the direction indicated by X2 is defined as "backward", and the direction indicated by Y2 is defined as "right".

In FIGS. 1 through 4, the developing apparatus U disposed around a photosensitive drum D as a photosensitive body has a developing vessel 1.

In the forward end portion (the photosensitive drum D-side portion, that is, the X1-side portion) of the developing vessel 1, a developing roll 2 is rotatably supported. In the backward side (X2-side) of the developing vessel 1, a toner supply roll 3 and an auger 4 are rotatably supported as toner supply members. The developing roll 2, the toner supply roll 3 and the auger 4 are cooperatively rotated by means of a transmission mechanism constituted by gears G1, G2 and G3 provided at one-end portions (right end portions or Y2-side end portions in FIG. 1) of shafts 2*a*, 3*a* and 4*a*, and idle gears G4 and G5 engaged with the gears G1, G2 and G3.

On the outside of one side wall 1*a* of the developing vessel 1, a bracket 10 formed of a thermoplastic molding (such as ABS, or the like) is disposed at an outer end portion of the shaft 2*a* of the developing roll 2. As shown in FIGS. 4, 5 and 6A, an elongated mount hole 10*a* permitting the shaft 2*a* to pass through, is formed in the bracket 10. The mount hole 10*a* is composed of two round hole portions 10*b* and 10*c* (see FIG. 6), and a linear round hole connection portion 10*d* for connecting the round hole portions 10*b* and 10*c*. Each of the round hole portions 10*b* and 10*c* has such a shape as to be easily turnable around the shaft 2*a* of the developing roll 2. The round hole connection portion 10*d* is formed so that its width is slightly smaller than the diameter of the shaft 2*a* of the developing roll 2.

The bracket 10 can be moved with respect to the developing roll shaft 2*a* in the condition that the developing roll shaft 2*a* passes through the mount hole 10*a*. That is, the bracket 10 can be moved from a position where the developing roll shaft 2*a* passes through one of the round hole portions 10*b* and 10*c* to a position where the shaft 2*a* passes through the other.

When the bracket 10 formed of a thermoplastic molding (such as ABS or the like) is moved in the direction perpendicular to the shaft 2*a*, a feeling of clicking can be obtained at the two positions of the round hole portions 10*b* and 10*c* so that the security of maintenance work can be improved.

A ring 11 having elasticity is provided at an end portion of the shaft 2*a* of the developing roll 2. The bracket 10 is pressed to the side wall 1*a* of the developing vessel 1 by the ring 11 to thereby limit the movement in the direction of the shaft 2*a* of the developing roll 2.

Further, the bracket 10 is fixed to the side wall 1*a* or 1*b* of the developing vessel 1 by a suitable position fixing screw so that it can be kept in a suitable posture.

Two wire fixing members 12 (see FIGS. 4 and 6A) and a wire positioning member 13 are provided on the forward end side (X1-side in FIG. 1) of the bracket 10. The forward surface (X1- side end surface) of the wire positioning member 13 has a curvature to prevent the electrode wire (which will be described later) in contact therewith from being broken.

An electrode supporting member S1 is constituted by the bracket 10, the ring 11, the wire fixing members 12 and the wire positioning member 13.

The round hole connection portion 10*d* of the mount hole 10*a* constitutes a radially movably supporting means for supporting the electrode supporting member S1 so as to be movable in the direction of radius of the developing roll 2. The round hole portion 10*b* of the mount hole 10*a* constitutes a circumferentially movably supporting means 10*b* for supporting the electrode supporting member S1 so as to be rotatable around an axis line parallel to the shaft 2*a* of the developing roll 2. As a result, the round hole connection portion 10*d* and the round hole portion 10*b* of the mount hole 10*a* constitute a movably supporting means P1.

Also on the other side wall 1*b* of the developing vessel 1, a bracket 14 is disposed at an outer end portion of the shaft 2*a* of the developing roll 2. The bracket 14 is provided with a mount hole 14*a* (see FIGS. 1 and 3A) of the same configuration as the mount hole 10*a*. The shaft 2*a* passes through the mount hole 14*a*. That is, the mount hole 14*a* is constituted by round hole portions 14*b* and 14*c* and a round hole connection portion 14*d* similar to the round hole portions 10*b* and 10*c* and round hole connection portion 10*d* of the mount hole 10*a*. A notch portion 14*e* (see FIGS. 2 and 3B) is provided in the bracket 14. The notch portion 14*e* is provided to avoid interference with the gear G4 of the above-mentioned transmission mechanism.

In FIG. 1, a ring 15 having elasticity is provided between the bracket 14 and the gear G1 and on the outer circumference of the shaft 2*a* of the developing roll 2. The bracket 14 is pressed against the side wall 1*b* of the developing vessel 1 to thereby limit the movement in the direction of the shaft 2*a*. Further, the bracket 14 is fixed to the side wall 1*a* or 1*b* of the developing vessel 1 by a suitable position fixing screw so that it can be kept in a suitable posture, in the same manner as in the bracket 10.

Two wire fixing members 16, 16 (see FIG. 3) and a wire positioning member 17 are also provided on the forward end side (X1-side in FIG. 1) of the bracket 14.

An electrode supporting member S2 is constituted by the respective constituent elements represented by the reference numerals 14, 16 and 17. Radially movably supporting means and circumferentially movably supporting means are constituted by the round hole connection portion 14*d* of the mount hole 14 and by the round hole portion 14*b* of the mount hole 14, respectively. As a result, the round hole connection portion 14*d* and the round hole portion 14*b* constitute a movably supporting means P2.

An electrode wire W1 is stretched between the two electrode supporting members S1 and S2. The electrode wire W1 is guided by the wire positioning members 13 and 17 while being kept in a tensioned state by a tension spring 18 provided for application of tensional force. The outer end portions of the wire are fixed by the wire fixing members 12 and 16.

Because the movements of the left and right brackets 10 and 14 in the direction of the shaft 2a of the developing roll 2 are respectively limited by the rings 11 and 15, the distance between the wire fixing members 13 and 16 can be kept constant. As a result, the tensional force of the electrode wire W1 produced by the tension spring 18 can be kept constant even in the case where the brackets 10 and 14 are moved.

Furthermore, as shown in FIG. 2, electrode terminal 41 electrically connected to the wire fixing member 16 is fixed at base of the wire fixing member 16. Therefore, the electrode terminal 41 is electrically connected with a connector C to supply voltages from the AC power supply and DC power supply. The connector C is composed of a lead wire 43 and a connecting terminal 42 press-fitted with the lead wire 43. By sliding the connector C in the direction shown by arrow in FIG. 2, the connector C and the electrode terminal 41 are electrically connected.

The operation of the Embodiment 1 will be described with reference to FIGS. 6A through 6C. Although description will be made upon left-side (Y1-side in FIG. 1) members of the apparatus U for convenience sake, it is to be understood that right-side (Y2-side in FIG. 1) members have the same configuration as that of the left-side members and that description thereof will be omitted.

As shown in FIG. 6A, in the condition of normal use of the apparatus, the shaft 2a of the developing roll 2 is fitted into the round hole portion 10c of the mount hole 10a of the bracket 10. In this case, as shown in FIG. 1, the electrode wire W1 is kept in an operative position near to the developing roll 2.

In the case where maintenance or the like is required, the bracket 10 is moved forward (in the X1 direction, that is, in the direction of radius of the developing roll 2) after the developing vessel 1 is departed from the photosensitive drum D. Then, the bracket 10 is moved while being guided by the round hole connection portion 10d of the mount hole 10a, so that the bracket 10 is finally stopped in a state where the shaft 2a is fitted in the round hole portion 10b as shown in FIG. 6B. In this state, the electrode wire W1 is kept in an inoperative position where it is far from the developing roll 2. Accordingly, a work space is produced between the electrode wire W1 and the developing roll 2.

The work space is however unsuitable as a space for cleaning the electrode wire W1, because the surface of the developing roll 2 abhorring deposition of foreign matter is not sufficiently far from the electrode wire W1. Therefore, as shown in FIG. 6C, the bracket 10 is rotated in the direction of the arrow R (in the direction of the circumference of the developing roll 2) around the shaft 2a. Then, the electrode wire W1 supported by the electrode supporting member S1 is moved to the side (right side in FIG. 6C) of the developing apparatus U, which is far from the toner layer forming portion of the developing roll 2. Accordingly, the electrode wire W1 is moved sufficiently far from the surface of the developing roll 2, so that foreign matter accumulated on the electrode wire W1 can be removed with ease and without damaging of the electrode wire W1 when maintenance work is performed in this condition.

Figure 7:
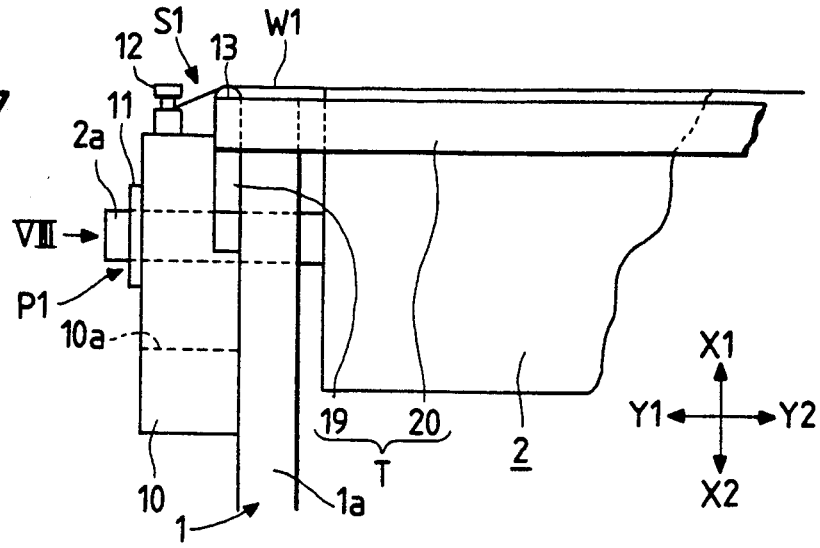
FIG. 7 is a view showing Embodiment 2 of the developing apparatus in correspondence with FIG. 4.
Figure 8:
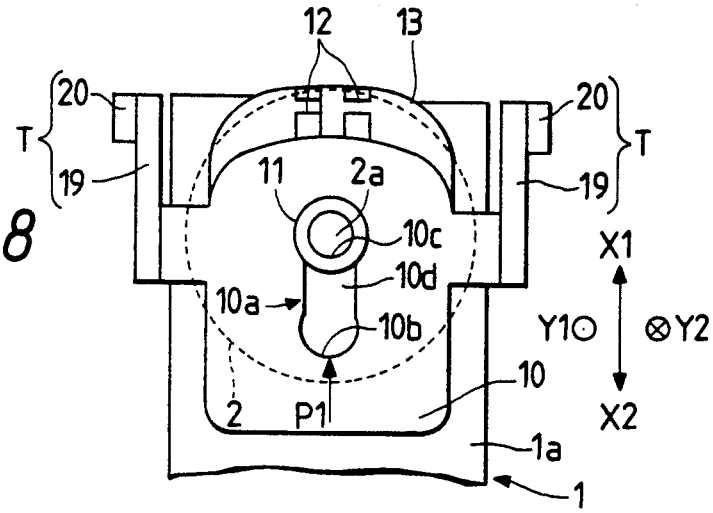
FIG. 8 is a view seen from the arrow VII in FIG. 7.

Second embodiment of the developing apparatus according to the present invention will be described below with reference to FIGS. 7 and 8.

This embodiment is different from the first embodiment in that the left and right electrode supporting members S1 and S2 in the second embodiment are connected by a connection member T.

That is, pole braces 19 are secured to sides of the brackets 10 and 14 of the left and right electrode supporting members S1 and S2, respectively. Upper ends of the pole braces 19 are connected by a connection bar 20. The pole braces 19 and connection bar 20 constitute one connection member T. A pair of such connection members T are provided to opposite sides of each of the brackets 10 and 14.

According to the second embodiment having the abovementioned configuration, the left and right electrode supporting members S1 and S2 can be moved while the relative position relation therebetween is fixed by the connection members T. As a result, the electrode wire W1 supported by the left and right electrode supporting members S1 and S2 is moved while being kept in a predetermined posture, so that there is no production of stress due to twisting in the electrode wire W1. Accordingly, not only the electrode wire W1 can be prevented from breaking accidents caused by twisting at the time of maintenance work, but simplification of work of moving the electrode wire W1 from an operative position to an inoperative position can be provided.

Third embodiment of the developing apparatus according to the present invention will be described below with reference to FIGS. 9 through 12.

This embodiment is different from the first embodiment in that the third embodiment is constituted so that a plurality of electrode wires W1, W2 are supported by left and right electrode supporting members S3, S4 (only S3 being shown in the drawings) and left and right movably supporting means P3, P4 (only P3 being shown in the drawings). Because the electrode supporting members S3, S4 and the movably supporting means P3, P4 are the same in configuration with respect to the left and right, description will be made singly upon the left-side (Y1-side or front side in FIG. 9) electrode supporting member S3 and the movably supporting means P3.

In description of the third embodiment, same numerals are given to constituent elements corresponding to the constituent elements of the Embodiment 1, so that detailed description thereof will be omitted.

Figure 9:
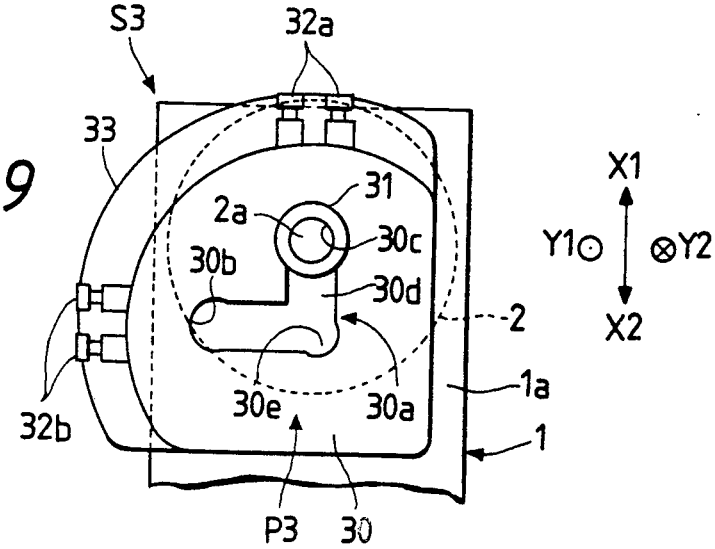
FIG. 9 is a view seen for explaining the operation of Embodiment 3 of the developing apparatus.
Figure 10:
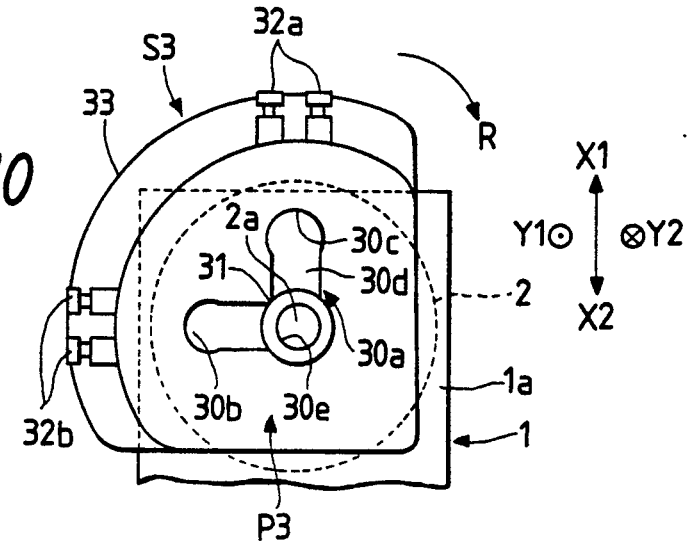
FIG. 10 is a view seen for explaining the operation of the Embodiment 3 of the developing apparatus.

In FIG. 9, an L-shaped mount hole 30a is formed in the bracket 30. The shaft 2a of the developing roll 2 passes through the mount hole 30a. The mount hole 30a is composed of two round hole portions 30b and 30c and an L-shaped round hole connection portion 30d for connecting the two round hole portions 30b and 30c. The L-shaped round hole connection portion 30d is composed of two linear portions perpendicular to each other, and a bent portion 30e for connecting the two linear portions. The bent portion 30e of the round hole connection portion 30d is formed so that the bracket 30 can be easily moved around the shaft 2a. That is, the bent portion 30e constitutes circumferentially movably supporting means. Except the bent portion 30e, the round hole connection portion 30d is formed so that its width is slightly smaller than the diameter of the shaft 2a of the developing roll 2.

A ring 31 having elasticity is provided at an end portion of the shaft 2*a* of the developing roll 2, so that the bracket 30 is pressed to the side wall 1*a* of the developing vessel 1 by the ring 31 to thereby limit movement in the direction of the shaft 2*a* of the developing roll 2.

The bracket 30 is fixed to the side walls 1*a* and 1*b* of the developing vessel 1 by suitable position fixing screws while it is kept in a suitable posture.

Wire fixing members 32*a* and 32*b* are provided to the bracket 30 on extension lines of the two perpendicularly intersecting linear portions of the round hole connection portion 30*d*. A continuous wire positioning member 33 is further provided thereto. Electrode wires W1 are respectively fixed to the onehand wire fixing members 32*a*, and spare electrode wires W2 are respectively fixed to the other-hand wire fixing members 32*b*.

In a condition shown in FIG. 9, the electrode wires W1 are kept in operative positions, and the electrode wires W2 are kept in inoperative positions.

The operation of the third embodiment will be described below.

As shown in FIG. 9, in the case of condition of normal use of the apparatus, the shaft 2*a* of the developing roll 2 is fitted into the round hole portion 30*c* of the mount hole 30*a* of the bracket 30. In this case, the electrode wires W1 are kept in operative positions near to the developing roll 2.

In the case where maintenance or the like is required, the bracket 30 is moved upward (in the X1 direction, that is, in the direction of radius of the developing roll 2). Then, the bracket 30 is moved while being guided by one linear portion of the round hole connection portion 30*d* extending in one direction, so that it finally goes to a state where the shaft 2*a* is fitted into the bent portion 30*e* of the round hole connection portion 30*d*. In this state, the electrode wires W1 are kept in inoperative positions far from the developing roll 2.

Figure 11:
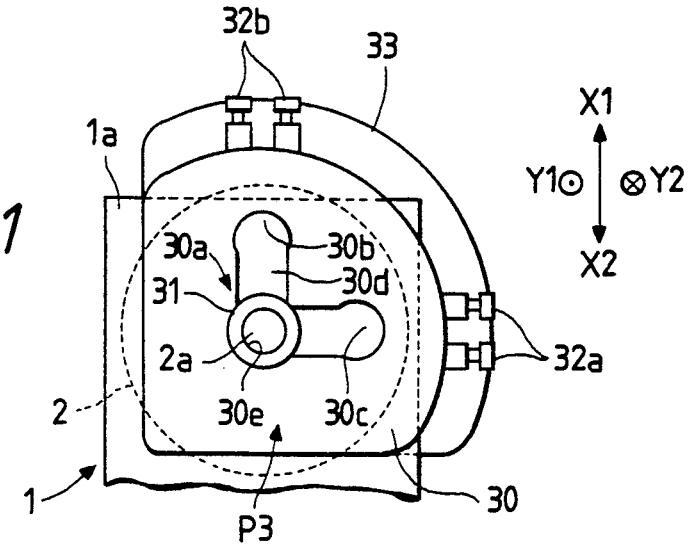
FIG. 11 is a view seen for explaining the operation of the Embodiment 3 of the developing apparatus.

When, in this state, the bracket 30 is rotated in the direction of the arrow R (in the direction of the circumference of the developing roll 2) around the bent portion 30*e* of the round hole connection portion 30*d*, a state shown in FIG. 11 is obtained. Then, the bracket 30 is moved backward (in the X2 direction). Then, the bracket 30 is moved while being guided by the other linear portion of the round hole connection portion 30*d* extending in the other direction, so that it is finally stopped in a state where the shaft 2*a* is fitted in the round hole portion 30*b* as shown in FIG. 12.

Figure 12:
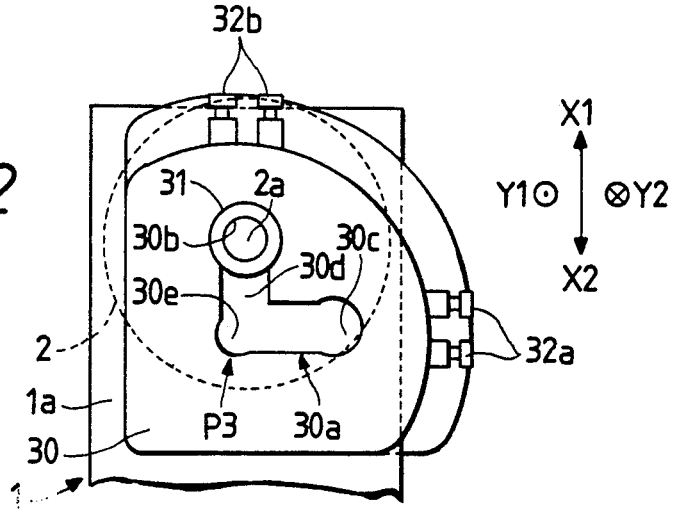
FIG. 12 is a view seen for explaining the operation of the Embodiment 3 of the developing apparatus.
Figure 13:
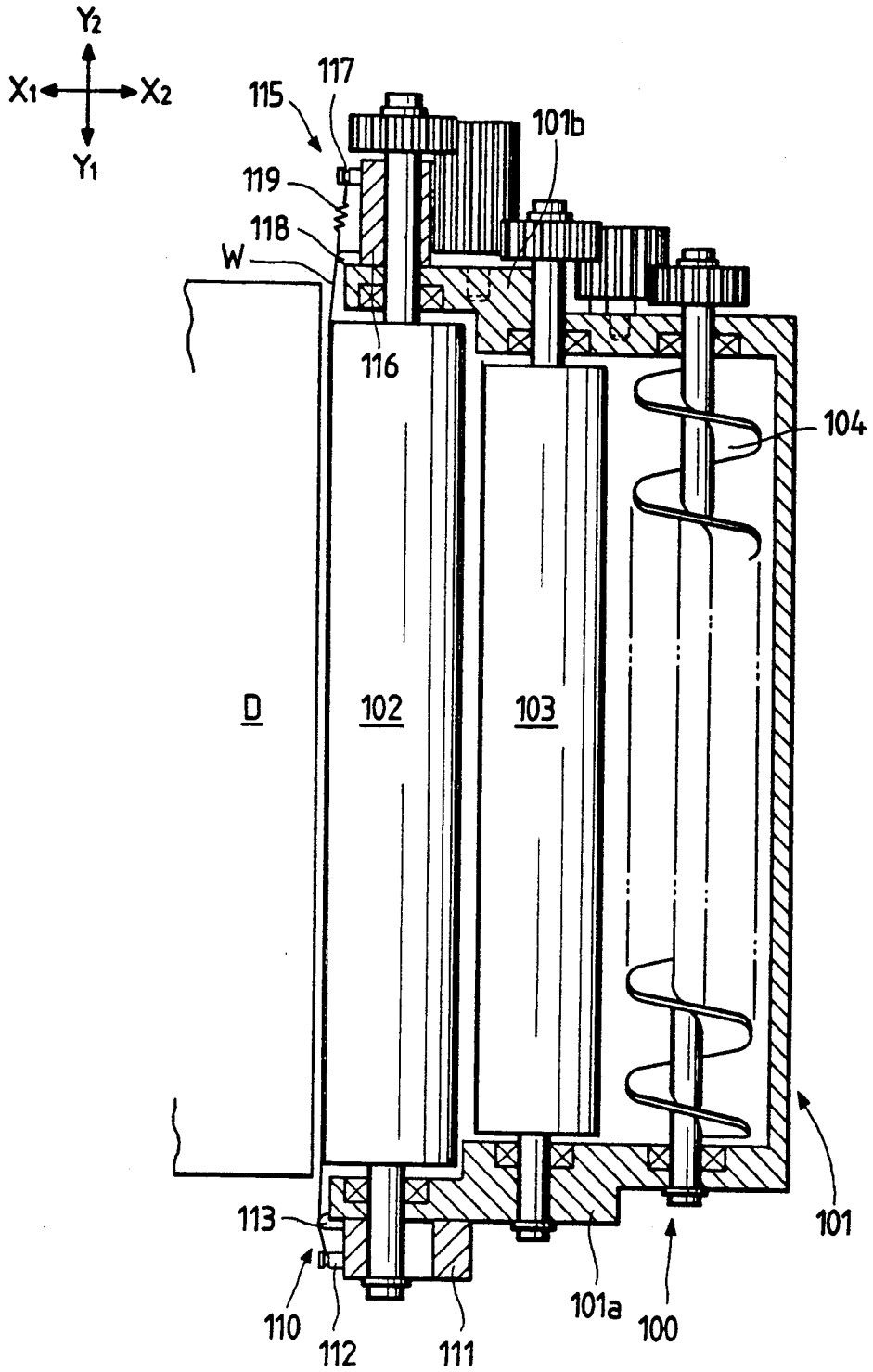
FIG. 13 is a horizontal sectional view of a conventional developing apparatus disposed around a photosensitive body.
Figure 14:
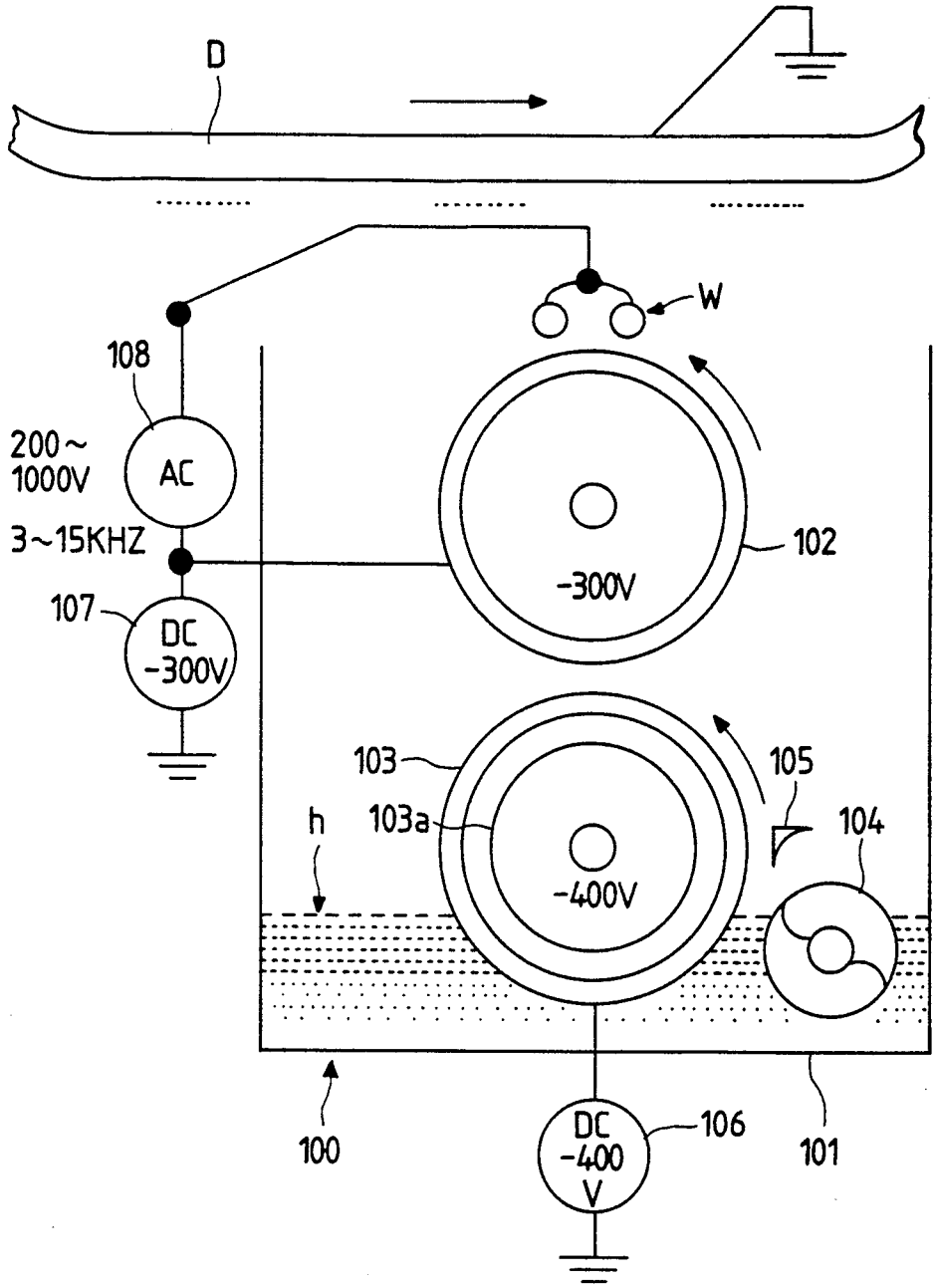
FIG. 14 PRIOR ART
FIG. 14 is a view seen for explaining the operation of the conventional developing apparatus disposed around a photosensitive body.

In the state shown in FIG. 12, the spare electrode wires W2 are kept in operative positions, and the above-mentioned electrode wires W1 are kept in maintenance positions.

According to the Embodiment 3 having the above-mentioned configuration, in the case where some electrode wire W1 in an operative position is broken, a spare electrode wire W2 in an inoperative position can be used directly without any electrode wire exchanging work.

Although embodiments of the developing apparatus according to the present invention have been described in detail, it is to be understood that the invention is not limited to the embodiments and that various modifications may be made without departing from the scope of the invention described in Claims.

For example, the respective numbers of electrode wires W1, W2 can be increased though the above-mentioned embodiments have been described upon the case where two electrode wires W1 and two spare electrode wires W2 are provided.

In the developing apparatus according to the present invention, the respective positions of the electrode wires for forming a toner cloud between the surface of the photosensitive body and the developing roll can be adjusted from operative positions near to the surface of the developing roll to inoperative or maintenance positions far from the surface of the developing roll. Accordingly, maintenance of the electrode wires can be made easy.

Furthermore, the electrode wires departed from the surface of the developing roll by the circumferentially movably supporting means can be moved to positions farther from the developing roll surface (the surface exposed from the developing vessel 1) by the circumferentially movably supporting means. Accordingly, maintenance of the electrode wires can be performed without staining the developing roll surface.

Furthermore, in the case where some electrode wire is broken, the electrode wire can be replaced by a spare electrode wire in an inoperative position so that the spare electrode wire can be used. In this case, electrode wire exchanging work can be performed in a shorter time.

Furthermore, the apparatus can be formed so that the electrode wires can be moved while being kept in predetermined postures supported by the electrode supporting members. In this case, maintenance work can be performed without damaging of the electrode wires caused by stress due to tension or the like.

What is claimed is:

1. A developing apparatus comprising:

a developing vessel for accommodating a developing roll having its surface on which a layer of toner to be deposited on a surface of a photosensitive body is formed, and further accommodating a toner supply member for supplying said toner to said developing roll;

electrode supporting members respectively arranged at opposite end portions of said developing roll in the direction of axis;

wire electrode means respectively supported by said electrode supporting members so as to be disposed between said surface of said photosensitive body and said developing roll;

field application means for applying an AC field between said electrode wires and said developing roll, whereby a toner cloud is formed between said surface of said photosensitive body and said developing roll by applying an AC field to said electrode wires; and movably supporting members for supporting said electrode supporting members movably between their operative positions and their inoperative positions so that said electrode wires supported by said respective electrode supporting members are kept in their operative positions near to the surface of said developing roll when said electrode supporting members are in their operative positions respectively, while the electrode wires supported by said electrode supporting members are kept in their inoperative positions far from the surface of said developing roll when said electrode supporting members are in their inoperative positions respectively.

2. A developing apparatus according to claim 1, wherein said electrode supporting members are connected by connection members for fixing relative positions of said electrode supporting members.

3. A developing apparatus according to claim 2, wherein said electrode supporting members have brackets supported to side walls of said developing vessel at said axially opposite end portions of said developing roll, and wire fixing members and wire positioning members supported by said brackets.

4. A developing apparatus according to claim 3, wherein said movably supporting members have radially movably supporting means for supporting said electrode supporting members so as to be movable in the direction of radius of said developing roll.

5. A developing apparatus according to claim 4, wherein said movably supporting members have circumferentially movably supporting means for supporting said electrode supporting members so as to be turnable around an axial line parallel to the axial line of said developing roll in the condition where said electrode supporting members are moved in said direction of radius of said developing roll by said radially movably supporting means so that said electrode wires are far from the surface of said developing roll.

6. A developing apparatus according to claim 5, wherein: each of said brackets in said electrode supporting members is provided with a normal wire fixing member for fixing an electrode wire used normally, and with an another, spare wire fixing member; and said wire fixing members are arranged so that when an electrode wire supported by one wire fixing member is kept in an operative position by said circumferentially movably supporting means, an electrode wire supported by the other wire fixing member is kept in an inoperative position.

7. A developing apparatus according to claim 1, wherein said electrode supporting members have brackets supported to side walls of said developing vessel at said axially opposite end portions of said developing roll, and wire fixing members and wire positioning members supported by said brackets.

8. A developing apparatus according to claim 7, wherein said movably supporting members have radially movably supporting means for supporting said electrode supporting members so as to be movable in the direction of radius of said developing roll.

9. A developing apparatus according to claim 8, wherein said movably supporting members have circumferentially movably supporting means for supporting said electrode supporting members so as to be turnable around an axial line parallel to the axial line of said developing roll in the condition where said electrode supporting members are moved in said direction of radius of said developing roll by said radially movably supporting means so that said electrode wires are far from the surface of said developing roll.

10. A developing apparatus according to claim 9, wherein: each of said brackets in said electrode supporting members is provided with a normal wire fixing member for fixing an electrode wire used normally, and with an another, spare wire fixing member; and said wire fixing members are arranged so that when an electrode wire supported by one wire fixing member is kept in an operative position by said circumferentially movably supporting means, an electrode wire supported by the other wire fixing member is kept in an inoperative position.

11. A developing apparatus according to any one of claims 4, 5, 6, 8, 9, and 10, wherein: said circumferentially movably supporting means are constituted by long mount holes which are formed in said brackets so that a shaft of said developing roll passes through said long mount holes; and each of said long mount holes has a shape by which said shaft of said developing roll passing through said mount holes is permitted to move relative to a direction of the length of said mount holes.

12. A developing apparatus according to claim 11, wherein: each of said brackets is formed of a thermoplastic molding; each of said long mount holes of said brackets through which the shaft of said developing roll passes is constituted by round hole portions at its opposite ends, and a round hole connection portion for connecting said round hole portions; each of said round hole portions has such a shape as to be easily rotatable around the shaft of said developing roll; and said round hole connection portion is formed so that it has a width slightly smaller than the diameter of the shaft of said developing roll.

13. A developing apparatus according to any one of claims 5, 6, 9, and 10, wherein said movably supporting means are constituted by L-shaped mount holes which are formed in said brackets so that a shaft of said developing roll passes through said L-shaped mount holes, characterized in that each of said L-shaped mount holes has such a shape that the shaft of said developing roll passing through the L-shaped mount hole is relatively movable along the L-shaped mount hole, and also has such a shape so as to be easily rotatable around said shaft.

14. A developing apparatus according to claim 13, wherein: each of said brackets is formed of a thermoplastic molding; each of said L-shaped mount holes of said brackets through which the shaft of said developing roll passes is composed of round hole portions at its opposite ends, and a round hole connection portion for connecting said round hole portions; said round hole connection portion is formed so that it has a width slightly smaller than the diameter of the shaft of said developing roll; and each of said round hole connection portions has a bent portion formed at its intermediate portion and shaped so as to be easily rotatable around the shaft of said developing roll.

* * * * *